US012702212B2

(12) United States Patent
Brown

(10) Patent No.: US 12,702,212 B2
(45) Date of Patent: Aug. 11, 2026

(54) HEAD WRAP APPARATUS

(71) Applicant: Dana Brown, Elizabethtown, KY (US)

(72) Inventor: Dana Brown, Elizabethtown, KY (US)

( * ) Notice: Subject to any disclaimer, the term of this patent is extended or adjusted under 35 U.S.C. 154(b) by 297 days.

(21) Appl. No.: 18/376,212

(22) Filed: Oct. 3, 2023

(65) Prior Publication Data

US 2025/0107604 A1 Apr. 3, 2025

(51) Int. Cl.
*A42B 1/041* (2021.01)
*A45D 8/40* (2006.01)

(52) U.S. Cl.
CPC ..... *A45D 8/40* (2013.01); *A42B 1/041* (2013.01)

(58) Field of Classification Search
CPC ..... A42B 1/041; A42B 1/04; A42B 1/049; A42B 1/22; A42B 1/208; A41D 3/08; A41D 23/00; A45D 8/40
See application file for complete search history.

(56) References Cited

U.S. PATENT DOCUMENTS 976,510 A * 11/1910 Siegel ..... A42B 1/041 24/1
1,256,205 A * 2/1918 Coolbroth ..... A42B 1/041 2/207
1,685,190 A * 9/1928 Curtis ..... A42B 1/041 2/171.01
1,712,290 A * 5/1929 Buckman ..... A42B 1/22 D2/886
2,023,683 A * 12/1935 Horn ..... A45D 44/12 132/274
2,044,521 A * 6/1936 Weiland ..... A45D 8/40 128/857
2,107,951 A * 2/1938 Lipton ..... A42B 1/041 2/171.7
2,263,418 A * 11/1941 Ganim ..... A42B 1/041 34/95.1
2,287,887 A * 6/1942 Kramer ..... A41D 23/00 D2/502
2,396,503 A * 3/1946 Green ..... A42B 1/041 2/202
2,417,323 A * 3/1947 Richards ..... A42B 1/12 D2/867
2,447,561 A * 8/1948 Brenner ..... A45D 8/40 383/41
2,462,727 A * 2/1949 Danelz ..... A41D 25/00 2/207
2,600,814 A * 6/1952 Tomarkin ..... A41D 23/00 D2/502
2,675,812 A * 4/1954 Berg ..... A45D 8/40 132/274
2,694,204 A * 11/1954 Campbell ..... A42B 1/041 2/174
2,698,944 A * 1/1955 Ramsby ..... A41D 15/00 2/48

(Continued)

*Primary Examiner* — Jillian K Pierorazio

(57) ABSTRACT

A head wrap apparatus for protecting a user's hair and makeup from damage includes a panel which is flexible and has a plurality of corners. The plurality of corners includes a first corner and a second corner which are positioned opposite each other across an edge of the panel. At least one strip is coupled to a surface of the panel. The at least one strip has a pair of ends, each which is coupled to the surface of the panel such that the at least one strip crimps the panel. Methods of using the head wrap apparatus are also disclosed.

8 Claims, 6 Drawing Sheets

(56) References Cited

U.S. PATENT DOCUMENTS 2,817,090 A * 12/1957 Toeliner ..... A42B 1/012 132/274
2,970,318 A * 2/1961 Nordling ..... A42B 1/206 2/205
3,076,972 A * 2/1963 Prophet ..... A42B 1/041 D2/867
3,105,242 A * 10/1963 Gettinger ..... A42B 1/041 D3/15
3,213,466 A * 10/1965 Gettinger ..... A42B 1/049 2/171.01
3,287,737 A * 11/1966 Schuessler ..... A42B 1/041 2/206
3,587,114 A * 6/1971 McCourtie ..... A42B 1/041 2/209.3
3,618,140 A * 11/1971 Goldfarb ..... A42B 1/045 2/207
5,144,696 A * 9/1992 Kahl ..... A42B 1/041 2/311
5,472,003 A * 12/1995 Frame ..... A45D 8/34 132/273
5,490,528 A * 2/1996 Day ..... A45D 20/20 2/202
5,636,384 A * 6/1997 Draughon ..... D04D 7/10 2/151
D397,836 S * 9/1998 Inspector ..... D2/501
6,032,292 A * 3/2000 Wood ..... A41D 23/00 2/9
6,131,197 A * 10/2000 Wang ..... A45D 44/08 2/88
7,437,777 B2 * 10/2008 Marquardt ..... A42B 1/012 2/202
D604,026 S * 11/2009 Dugger ..... D2/500
7,634,819 B2 12/2009 Grey
D629,180 S * 12/2010 Hood ..... D2/880
D747,069 S * 1/2016 Son ..... D2/500
D769,584 S 10/2016 Yates
D787,163 S * 5/2017 Yates ..... D2/889
9,907,381 B2 * 3/2018 Tussey ..... A42B 1/049
10,694,799 B1 * 6/2020 Gonzalez ..... A45D 20/00
2001/0037518 A1 * 11/2001 Whitfield ..... A45D 44/12 2/205
2002/0104150 A1 * 8/2002 Hill ..... A42B 1/041 2/174
2002/0156407 A1 * 10/2002 Estep ..... A61F 5/3746 602/4
2005/0132471 A1 * 6/2005 McGreggor ..... A42B 1/049 2/202
2006/0253959 A1 * 11/2006 Chang ..... A42B 1/16 2/207
2007/0056079 A1 * 3/2007 Didier ..... A42B 1/041 2/171
2007/0094768 A1 * 5/2007 Moudgill ..... A45D 8/36 2/171
2009/0000011 A1 1/2009 Halley
2010/0299807 A1 * 12/2010 Saito ..... A42B 1/041 2/174
2012/0240309 A1 * 9/2012 Albright ..... A42B 1/041 2/181
2016/0249696 A1 * 9/2016 Wallen ..... A41D 23/00 2/91
2017/0311692 A1 * 11/2017 Morgan ..... A45D 20/18
2018/0310695 A1 * 11/2018 Kim ..... A45D 6/00
2020/0121052 A1 * 4/2020 McKay ..... A42B 1/041
2020/0178634 A1 * 6/2020 Brown ..... A42B 1/041
2022/0132968 A1 * 5/2022 Denu ..... A42B 1/049 2/171.5
2022/0346518 A1 * 11/2022 Cohen ..... A47K 10/02
2023/0142805 A1 * 5/2023 Patrick ..... A45D 8/36 132/222
2023/0180905 A1 * 6/2023 Woodard ..... A41D 23/00 132/274
2024/0215771 A1 * 7/2024 McKay ..... A47K 10/02

* cited by examiner

HEAD WRAP APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to head wrap apparatuses and more particularly pertains to a new head wrap apparatus for protecting a user's hair and makeup from damage.

(2) Description of Related Art Including Information Disclosed Under 37 CFR 1.97 and 1.98

The prior art discloses myriad head wraps, covers, scarves, and the like for protecting a user's hair. However, the prior art does not describe a hair wrap which includes elements that cause a curvature to form in the hair wrap. A hair wrap which includes such elements can be draped over the head of the user to retain clothing away from the face when dressing and undressing, which prevents the clothing from interfering with makeup worn on the user's face. Such a wrap may also be worn on the user's head to protect the hair from abrasive damage.

BRIEF SUMMARY OF THE INVENTION

An embodiment of the disclosure meets the needs presented above by generally comprising a panel which is flexible and has a plurality of corners. The plurality of corners includes a first corner and a second corner which are positioned opposite each other across an edge of the panel. At least one strip is coupled to a surface of the panel. The at least one strip has a pair of ends, each which is coupled to the surface of the panel such that the at least one strip crimps the panel.

Another embodiment of the disclosure generally comprises a method of preventing smearing of makeup worn on a face of a user by an article of clothing moving past the face.

The method includes draping a head of the user with a head wrap apparatus comprising a panel and at least one strip arranged on the panel to crimp the panel. The at least one strip is positioned in front of the user such that the at least one strip curves the panel away from the face of the user. The article is then moved across the face with the head wrap apparatus positioned between the face and the article so the head wrap apparatus retains the article away from the face of the user.

Yet another embodiment of the disclosure generally comprises a method of using the head wrap apparatus to prevent abrasion of a quantity of hair of the user. The panel of the head wrap apparatus has a square shape, which under the method is folded along a first fold line extending between a pair of opposite corners of the panel to form a triangle comprising two coextensive triangular portions of the panel. Thus formed, the triangle has a folded edge, a first vertex and a second vertex opposing each other across the folded edge, and a third vertex opposite the folded edge. The folded edge is wrapped around the head of the user and a portion of the triangle adjacent to the first vertex is tied to a portion of the triangle adjacent to the second vertex to form a knot positioned on the forehead of the user. The triangle is wrapped up and around the head of the user such that the triangle at least partially covers the quantity of hair. The third vertex may be tucked between the forehead and the knot.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
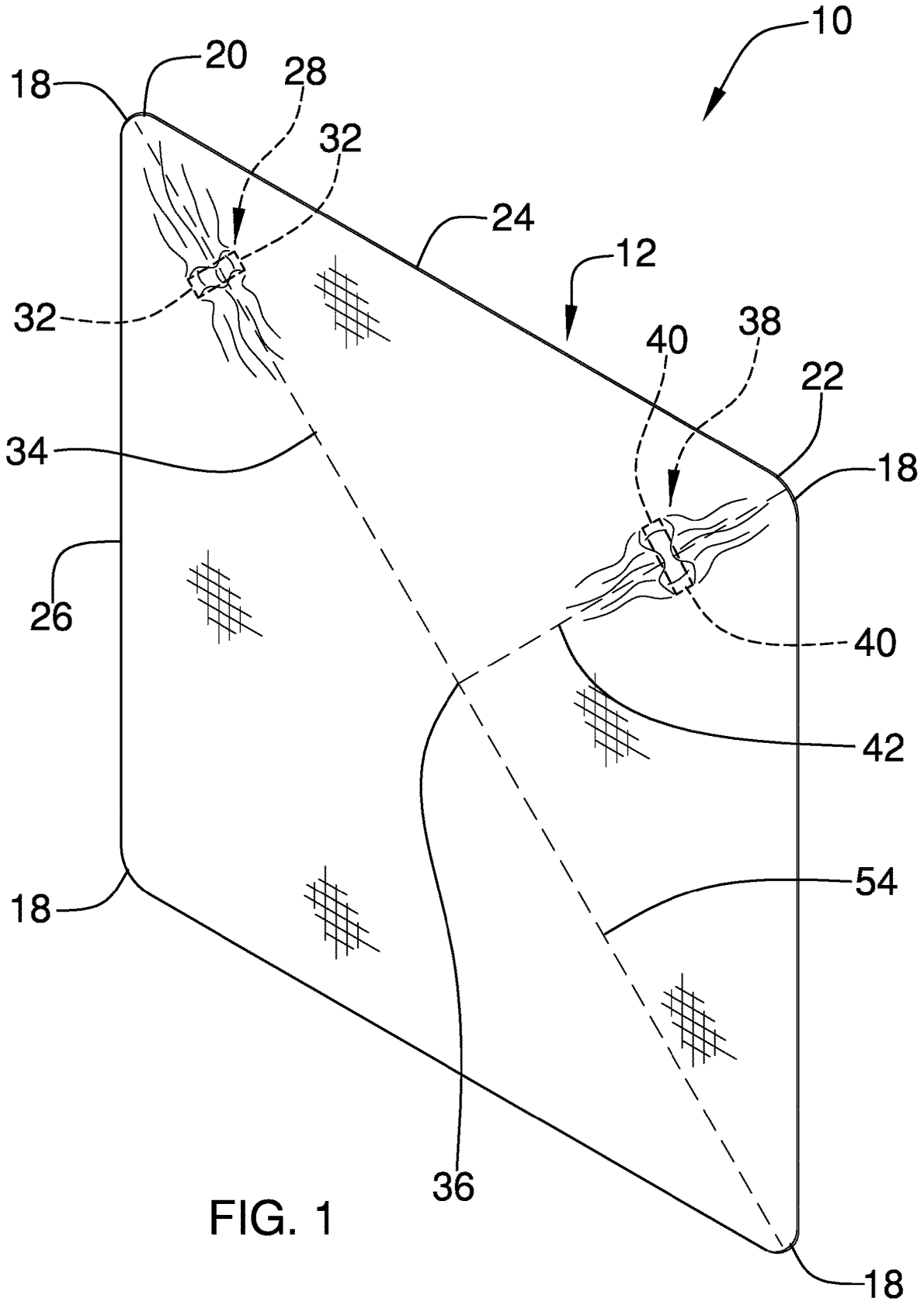
FIG. 1 is a perspective view of a head wrap apparatus according to an embodiment of the disclosure.
Figure 2:
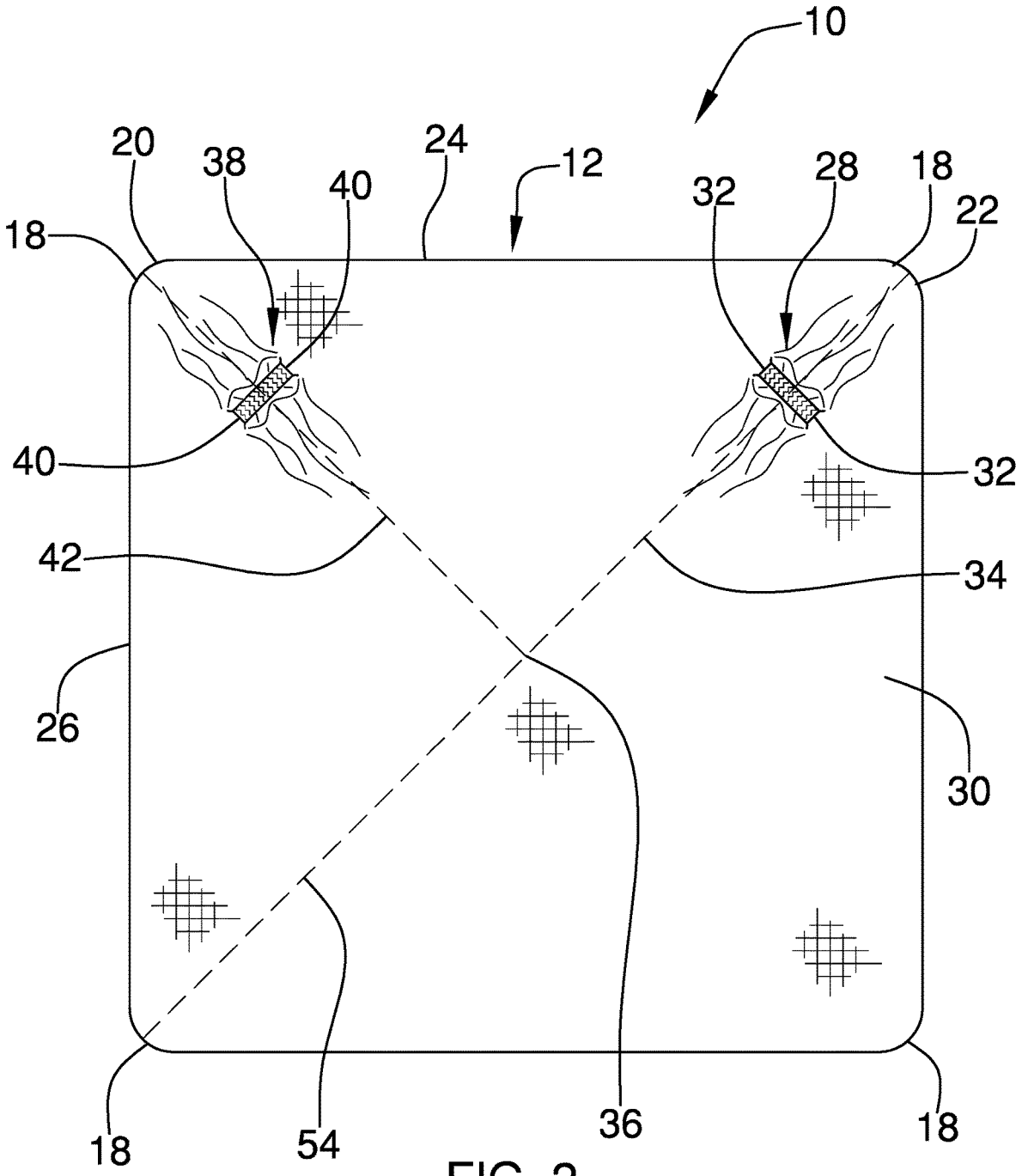
FIG. 2 is a rear view of an embodiment of the disclosure.
Figure 3:
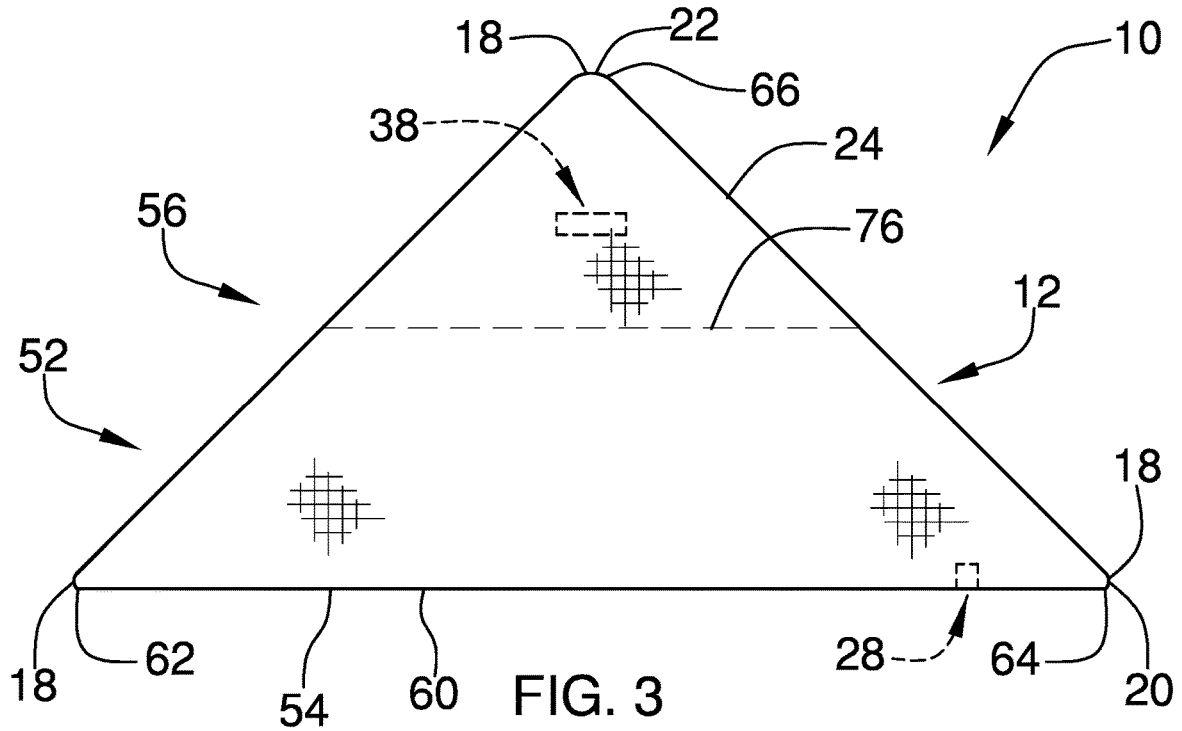
FIG. 3 is a front view of an embodiment of the disclosure being folded for usage in a second use mode.
Figure 4:
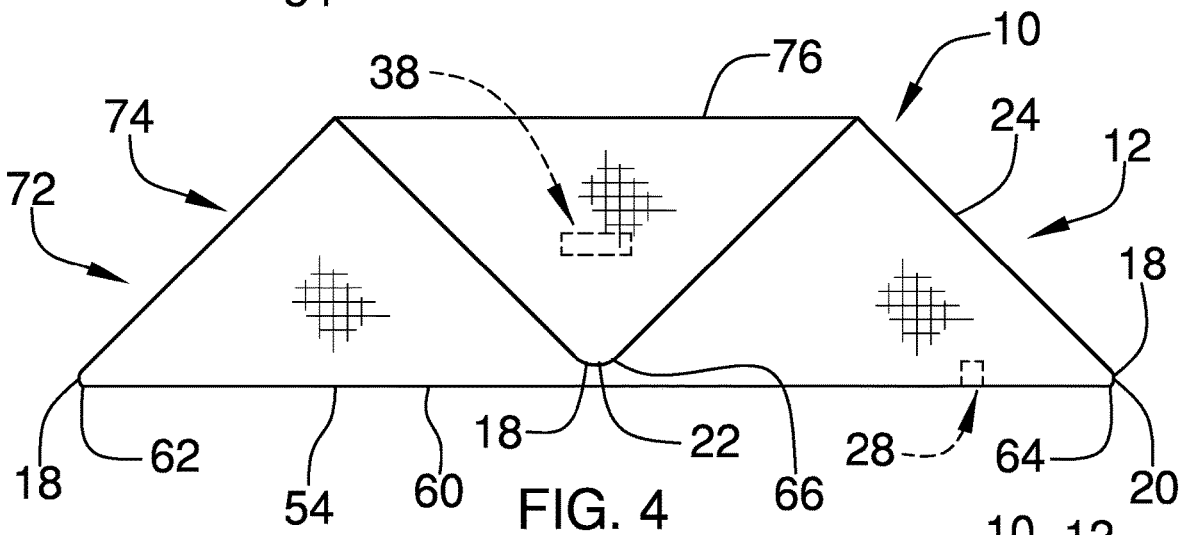
FIG. 4 is a front view of an embodiment of the disclosure being folded in a first variation for usage in a third use mode.
Figure 5:
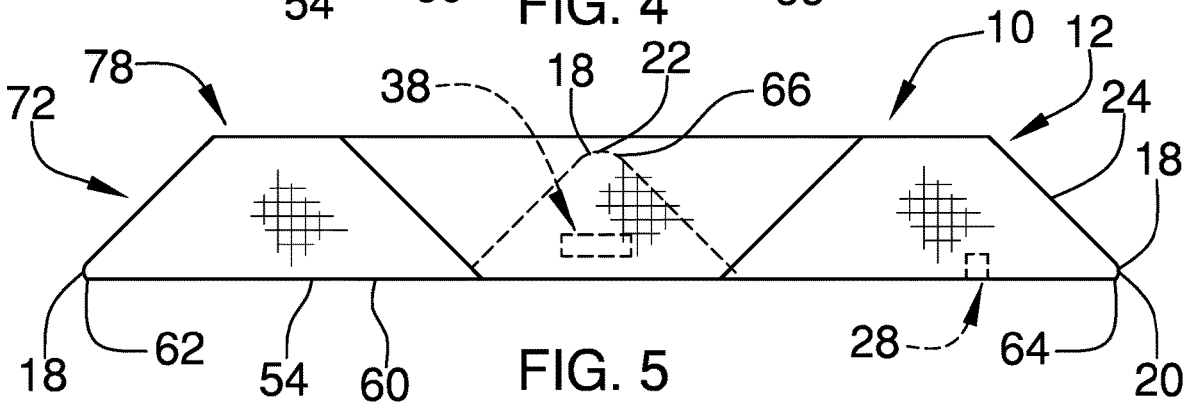
FIG. 5 is a front view of an embodiment of the disclosure being folded in a second variation for usage in a third use mode.
Figure 6:
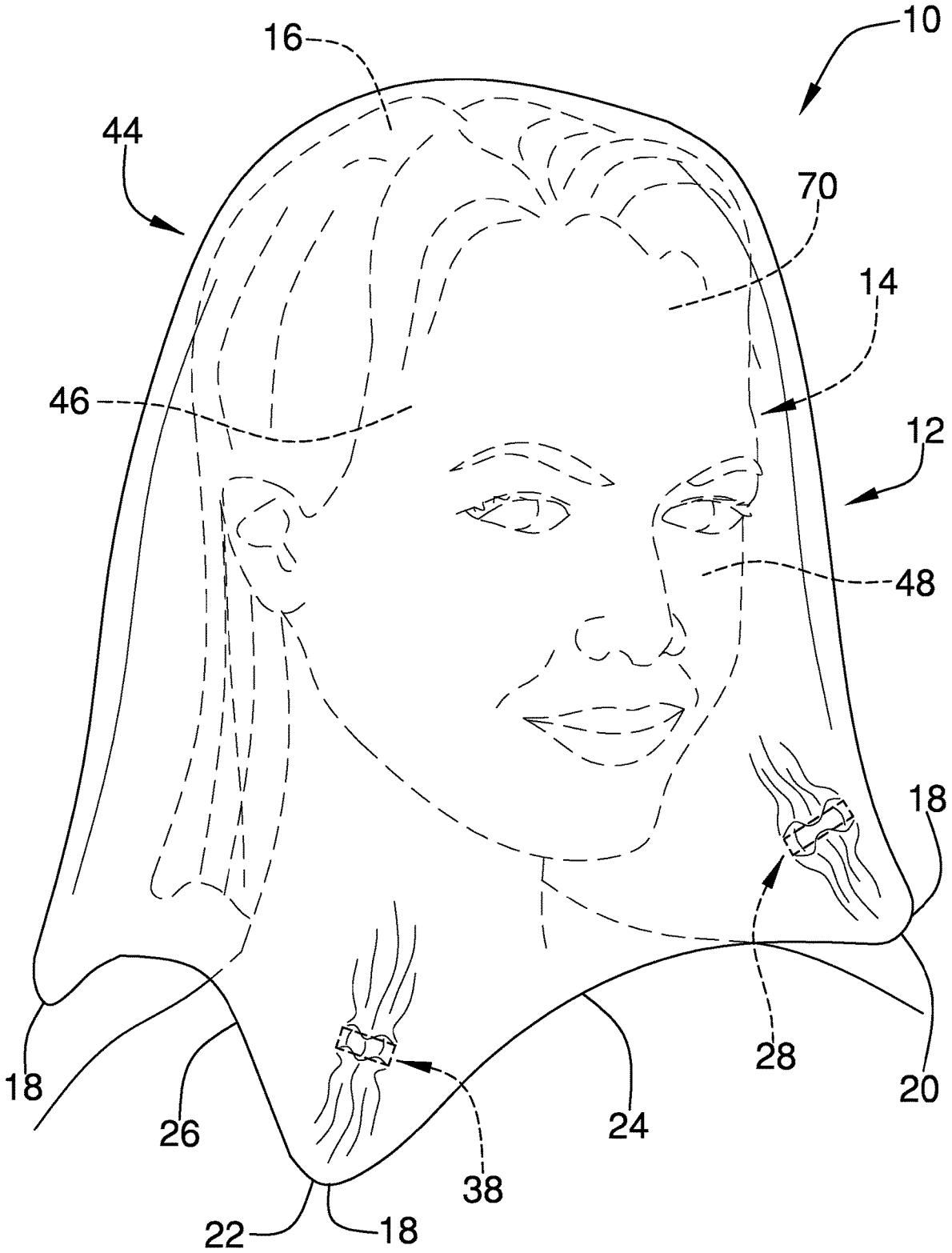
FIG. 6 is an in-use view of an embodiment of the disclosure in a first use mode.
Figure 7:
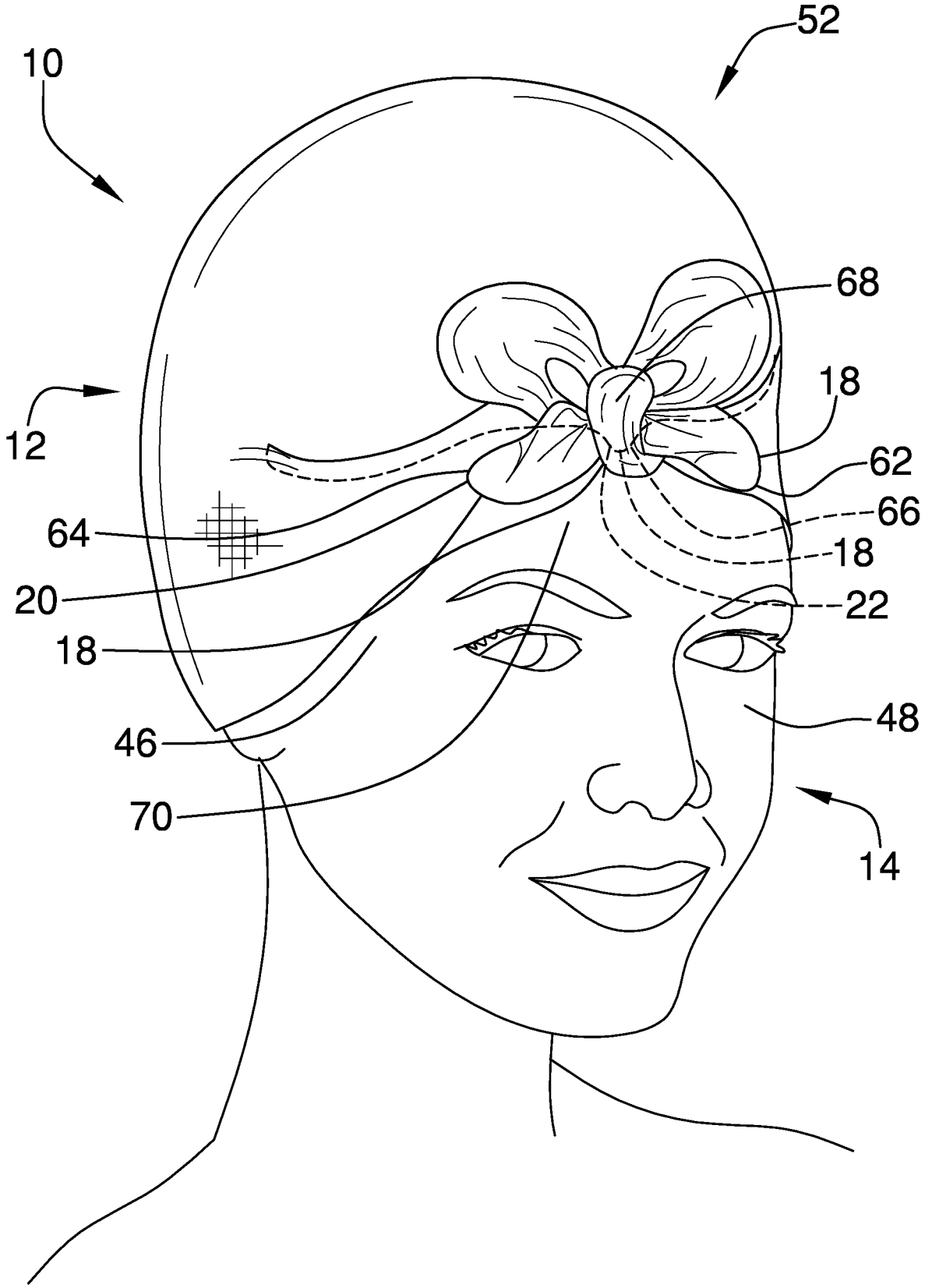
FIG. 7 is an in-use view of an embodiment of the disclosure in a second use mode.
Figure 8:
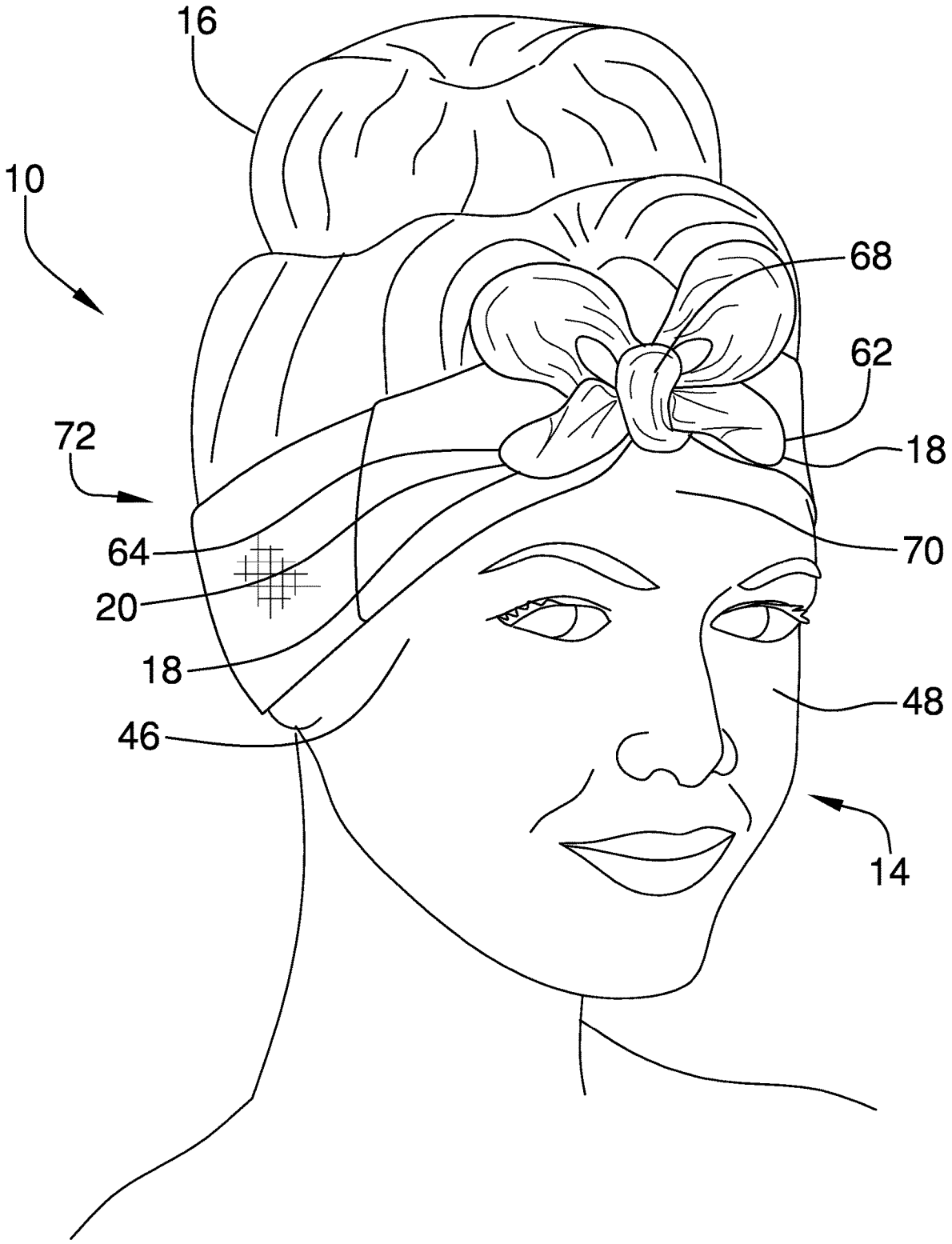
FIG. 8 is an in-use view of an embodiment of the disclosure in a third use mode.

With reference now to the drawings, and in particular to FIGS. 1 through 8 thereof, a new head wrap apparatus embodying the principles and concepts of an embodiment of the disclosure and generally designated by the reference numeral 10 will be described.

As best illustrated in FIGS. 1 through 8, the head wrap apparatus 10 generally comprises a panel 12 which is flexible. The panel 12 is also smooth such that the panel 12 is configured to engage a quantity of hair 16 of a user 14 without abrading the quantity of hair 16. The panel 12 may be constructed of silk, satin, or like material. The panel 12 has a plurality of corners 18 which includes a first corner 20 and a second corner 22 that are positioned opposite each other across an edge 24 of the panel 12. Each corner 18 of the panel 12 is rounded. The panel 12 has a square shape 26 and has a width of between 30.0 inches and 38.0 inches.

A first strip 28 is coupled to a surface 48 of the panel 12. The first strip 28 has a pair of ends 32, each of which is coupled to the surface 48 of the panel 12 such that the first strip 28 crimps the panel 12. The first strip 28 is positioned adjacent to the first corner 20 and extends transversely across a first line 34 extending between a center 36 of the panel 12 and the first corner 20 of the panel 12. A second strip 38 is also coupled to the surface 48 of the panel 12. The second strip 38 likewise has a pair of ends 40, each of which is coupled to the surface 48 of the panel 12 such that the second strip 38 crimps the panel 12. The second strip 38 is positioned adjacent to the second corner 22 and extends transversely across a second line 42 extending between the center 36 of the panel 12 and the second corner 22 of the panel 12. Each of the first strip 28 and the second strip 38 is elastically stretchable, comprising nylon, elastane, rubber, or the like.

The head wrap apparatus 10 has multiple uses. In a first use mode 44, the head wrap apparatus 10 is draped over a head 46 of the user 14 to prevent smearing of makeup worn on a face 48 of the user 14 by an article of clothing moving past the face 48. The first and second strips 28, 38 are positioned in front of the user 14 such that the first and second strips 28, 38 crimp the panel 12 to curve it away from the face 48 of the user 14. The article of clothing is moved past the face 48, such as donning or removing the article, with the head wrap apparatus 10 positioned between the face 48 and the article. The head wrap apparatus 10 maintains the article of clothing away from the face 48 as the article moves past the face 48.

In a second use mode 52, the head wrap apparatus 10 is used to prevent abrasion of the quantity of hair 16 of the user 14. In this second use mode 52, the panel 12 is folded along a first fold line 54 extending between a pair of opposite corners 18 of the panel 12 to form a triangle 56 comprising two coextensive triangular portions of the panel 12. The triangle 56 thus formed has a folded edge 60, a first vertex 62 and a second vertex 64 opposing each other across the folded edge 60, and a third vertex 66 opposite the folded edge 60. The folded edge 60 is wrapped around the head 46 of the user 14 and a portion of the triangle 56 adjacent to the first vertex 62 is tied to a portion of the triangle 56 adjacent to the second vertex 64 to form a knot 68 positioned on a forehead 70 of the user 14. The term "knot" as used in the specification and the claims includes bows and other decorative folds, which may be made to retain the first and second vertexes 62, 64 away from the face 48 of the user 14 and for ornamental purposes. The triangle 56 is wrapped up and around the head 46 of the user 14 such that the triangle 56 at least partially covers the quantity of hair 16. The third vertex 66 of the triangle 56 is tucked between the forehead 70 and the knot 68 to secure the triangle 56 around the head 46 and the quantity of hair 16 of the user 14.

In a third use mode 72, the head wrap apparatus 10 is used as a headband. In this third use mode 72, the triangle 56 of the second use mode 52 is formed. In a first variation 74 of the third use mode 72, the panel 12 is folded along a second fold line 76 positioned between the folded edge 60 of the triangle 56 and the third vertex 66 of the triangle 56 such that the third vertex 66 is positioned adjacent to and facing the folded edge 60. In a second variation 78 of the third use mode 72, the third vertex 66 is moved to wrap the panel 12 around the folded edge 60 at least once, and the panel 12 is laid flat. In either of the first or second variation 74, 78, the panel 12 is wrapped around the head 46 of the user 14 and a portion of the panel 12 adjacent to the first vertex 62 is tied to a portion of the panel 12 adjacent to the second vertex 64 to form the knot 68, which is positioned on the forehead 70 of the user 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A head wrap apparatus comprising:

a panel being flexible, the panel having a plurality of corners, the plurality of corners including a first corner and a second corner being positioned opposite each other across an edge of the panel; and at least one strip being coupled to a surface of the panel, the at least one strip having a pair of ends, each end of the at least one strip being coupled to the surface of the panel such that the at least one strip crimps the panel, wherein the at least one strip includes a first strip being coupled to the surface of the panel, the first strip having a pair of ends, each end of the first strip being coupled to the surface of the panel such that the first strip crimps the panel, the first strip being positioned adjacent to the first corner, a second strip being coupled to the surface of the panel, the second strip having a pair of ends, each end of the second strip being coupled to the surface of the panel such that the second strip crimps the panel, the second strip being positioned adjacent to the second corner, and wherein the first strip extends transversely and perpendicularly across a first line extending between a center of the panel and the first corner of the panel, the second strip extending transversely and perpendicularly across a second line extending between the center of the panel and the second corner of the panel.

2. The apparatus of claim 1, wherein the panel being smooth such that the panel is configured to engage a quantity of hair of a user without abrading the quantity of hair.

3. The apparatus of claim 2, wherein the panel is constructed of silk.

4. The apparatus of claim 2, wherein the panel is constructed of satin.

5. The apparatus of claim 1, wherein each corner of the panel is rounded.

6. The apparatus of claim 1, wherein the panel has a square shape.

7. The apparatus of claim 6, wherein the panel has a width of between 30.0 inches and 38.0 inches.

8. The apparatus of claim 1, wherein each of the first strip and the second strip is elastically stretchable.

* * * * *